US008094849B2

(12) United States Patent
Freels et al.

(10) Patent No.: US 8,094,849 B2
(45) Date of Patent: Jan. 10, 2012

(54) SOUND CHANNEL FOR A HEARING APPARATUS AND CORRESPONDING PRODUCTION PROCESS

(75) Inventors: Björn Freels, Hersbruck (DE); Holger Kral, Fürth (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 783 days.

(21) Appl. No.: 12/284,142

(22) Filed: Sep. 18, 2008

(65) Prior Publication Data

US 2009/0074217 A1 Mar. 19, 2009

(30) Foreign Application Priority Data

Sep. 18, 2007 (DE) ..... 10 2007 044 550

(51) Int. Cl.
*H04R 25/00* (2006.01)

(52) U.S. Cl. ..... 381/322; 381/330

(58) Field of Classification Search ..... 381/322, 381/315, 312, 330; 164/132
See application file for complete search history.

(56) References Cited

U.S. PATENT DOCUMENTS

| | | | | |
|---|---|---|---|---|
| 1,544,930 | A | 7/1925 | Pack | |
| 6,962,189 | B2 | 11/2005 | Buckley | |
| 7,174,028 | B1 | 2/2007 | Niccolai | |
| 7,221,770 | B2 | 5/2007 | Fickweiler et al. | |
| 7,720,243 | B2 * | 5/2010 | Brumback et al. | 381/328 |
| 2006/0159298 | A1 * | 7/2006 | von Dombrowski et al. | 381/330 |
| 2006/0239481 | A1 * | 10/2006 | Martin | 381/312 |
| 2010/0272299 | A1 * | 10/2010 | Van Schuylenbergh et al. | 381/315 |

FOREIGN PATENT DOCUMENTS

| | | | |
|---|---|---|---|
| DE | 1807193 | | 5/1970 |
| DE | 195 30 254 | A1 | 2/1997 |
| DE | 102 47 524 | A1 | 4/2004 |
| DE | 103 33 293 | A1 | 3/2005 |
| GB | 622456 | | 5/1949 |
| GB | 2025836 | A1 | 1/1980 |
| JP | 07304057 | A | 11/1995 |
| WO | 99/20417 | A1 | 4/1999 |

* cited by examiner

*Primary Examiner* — Thao P. Le

(57) ABSTRACT

A mechanically more stable and more complexly molded sound channel is to be provided for a hearing apparatus. Provision is made to this end for a sound channel, which has three sections in the longitudinal direction, the middle section of which has a different curvature or a larger internal circumference than the two outer sections, to be produced by injection molding. Here a negative of the sound channel is fixed within the injection molded form, with the negative consisting of a first material. The injection molded form with a second material, which has a higher melting point than the first material, is then extruded. The negative is then melted or burnt out of the cast sound channel. Very complex sound channel forms, for instance also with cavities and branching, can be realized in this way.

19 Claims, 3 Drawing Sheets

SOUND CHANNEL FOR A HEARING APPARATUS AND CORRESPONDING PRODUCTION PROCESS

CROSS REFERENCE TO RELATED APPLICATIONS

This application claims priority of German application No. 10 2007 044 550.6 DE filed Jul. 5, 2004, which is incorporated by reference herein in its entirety.

FIELD OF INVENTION

The present invention relates to a method for producing a sound channel for a hearing apparatus. The present invention also relates to a corresponding sound channel for a hearing apparatus. The term "hearing apparatus" is understood here to mean in particular a hearing device but also any other device for outputting sound which can be worn on or in the ear, like for instance a headset, earphones and such like.

BACKGROUND OF INVENTION

Hearing devices are wearable hearing apparatuses which are used to assist the hard-of-hearing. In order to accommodate numerous individual requirements, various types of hearing devices are available such as behind-the-ear (BTE) hearing devices, hearing device with an external receiver (RIC: receiver in the canal) and in-the-ear (ITE) hearing devices, for example also concha hearing devices or completely-in-the-canal (ITE, CIC) hearing devices. The hearing devices listed as examples are worn on the outer ear or in the auditory canal. Bone conduction hearing aids, implantable or vibrotactile hearing aids are also available on the market. The damaged hearing is thus stimulated either mechanically or electrically.

The key components of hearing devices are principally an input converter, an amplifier and an output converter. The input converter is normally a receiving transducer e.g. a microphone and/or an electromagnetic receiver, e.g. an induction coil. The output converter is most frequently realized as an electroacoustic converter e.g. a miniature loudspeaker, or as an electromechanical converter e.g. a bone conduction hearing aid. The amplifier is usually integrated into a signal processing unit. This basic configuration is illustrated in FIG. 1 using the example of a behind-the-ear hearing device. One or a plurality of microphones 2 for recording ambient sound are built into a hearing device housing 1 to be worn behind the ear. A signal processing unit 3 which is also integrated into the hearing device housing 1 processes and amplifies the microphone signals. The output signal for the signal processing unit 3 is transmitted to a loudspeaker or receiver 4, which outputs an acoustic signal. Sound is transmitted through a sound tube, which is affixed in the auditory canal by means of an otoplastic, to the device wearer's eardrum. Power for the hearing device and in particular for the signal processing unit 3 is supplied by means of a battery 5 which is also integrated in the hearing device housing 1.

SUMMARY OF INVENTION

One main objective in terms of hearing device development is to accommodate as many components as possible in as small a housing as possible. To this end, a high degree of creative freedom in the case of individual components is very beneficial. This applies equally to active and passive components. It is also particularly advantageous if the connecting element between the wearing hook and receiver, i.e. the sound channel between both components, can be molded according to requirements.

In respect of the connecting element, there is also the need for the connection between the sound tube connecting piece (wearing hook) and the receiver and/or hearing device to be produced in a mechanically stable and acoustically tight fashion. The connection is to be realizable as a screw or plug-in connection or a combination of the two. If necessary, the connecting element is also to be able to adopt the bearing functions for one component of the hearing device.

It is also desirable for the connecting element to be producible in a cost-effective fashion despite the high demands placed on its accuracy and stability and to take up as little space as possible. For optimal space utilization in the housing, it is particularly desirable for a high degree of creative freedom to be provided for the component. In some circumstances it is namely necessary for undercuts to be provided on the connecting element and/or sound channel.

Connecting pieces made of metal are currently used in hearing devices primarily as connecting elements between the receiver and the wearing hook. These are complicated turning and milling parts, which in most cases subsequently still have to be bent. They are generally designed for screw or plug-in connections and/or combinations of the two.

Plug-in connectors made of plastic are also known. Solutions, in which a metal connecting piece and a plastic wearing frame for the hearing device components are integrated in an injection-molded part, are known from practice.

The object of the present invention consists in providing a sound channel for a hearing apparatus, which has a relatively complex form and can consequently be easily produced and is mechanically stable.

This object is achieved in accordance with the invention by means of a method for producing a sound channel for a hearing apparatus, which has three sections in the longitudinal direction, the middle section of which has a different curvature or a larger internal circumference than the two outer sections, by providing an injection-molded form for the sound channel, fixing a negative of the sound channel within the injection-molded form, with the negative consisting of a first material, effusing the injection-molded form with a second material, which has a higher melting point than the first material and melting or burning the negative out of the cast sound channel.

Provision is also made in accordance with the invention for a sound channel for a hearing apparatus, which has three sections in the longitudinal direction, the middle section of which has a different curvature or a larger internal circumference than the two outer sections and which is injection-molded in accordance with the above method.

During the production using injection molding technology, the sound channel is advantageously no longer restricted in respect of its shape such that it only has two differently curved sections, with which it is possible to ensure that the casting mold parts can be drawn from the newly injected sound channel in both longitudinal directions which are opposite to one another. Since the negative located inside the newly injected sound channel is not extracted but is instead melted or burnt out, almost any forms of the negative are possible. Injection molding simultaneously provides for precise and mechanically stable injection molded elements.

According to a special embodiment, the second material, in other words the extruded material, can be a metal. Metals are characterized by their high robustness particularly also in the case of bending stress. In particular, it is expedient to use titanium as metal, which is in particular very light compared with steel and on the other hand is resistant to lower concentrations of sulfuric acid and hydrochloric as well as most organic acids.

According to a further preferred embodiment, the second material, from which the sound channel is extruded, is a ceramic and in particular a ceramic which contains zirconium oxide. The ceramics are not only characterized by their high mechanical stability, but are instead also characterized by the low thermal expansion coefficients. After the extrusion process, the sound channels can be sintered. The ceramic injection molded part is as a result further compacted and hardened.

It is particularly advantageous if the negative is a plastic injection-molded part. Plastic negatives of this type can, due to their low melting point, be easily melted or burnt out of the metal or ceramic sound channels.

One or several nozzles, cavities and such like can be molded into or onto the sound channel. Nozzles or cavities of this type can be advantageous for acoustic reasons and do not present any problems when demolding the injection-molded parts, here the melting or burning process of the negative.

The sound channel can also have at least one branching. This can also provide acoustic advantages and also present no problems in respect of demolding.

BRIEF DESCRIPTION OF THE DRAWINGS

The present invention is described in more detail with reference to the appended drawings, in which.

DETAILED DESCRIPTION OF INVENTION

The exemplary embodiments illustrated in more detail below represent preferred embodiments of the present invention.

Figure 1:
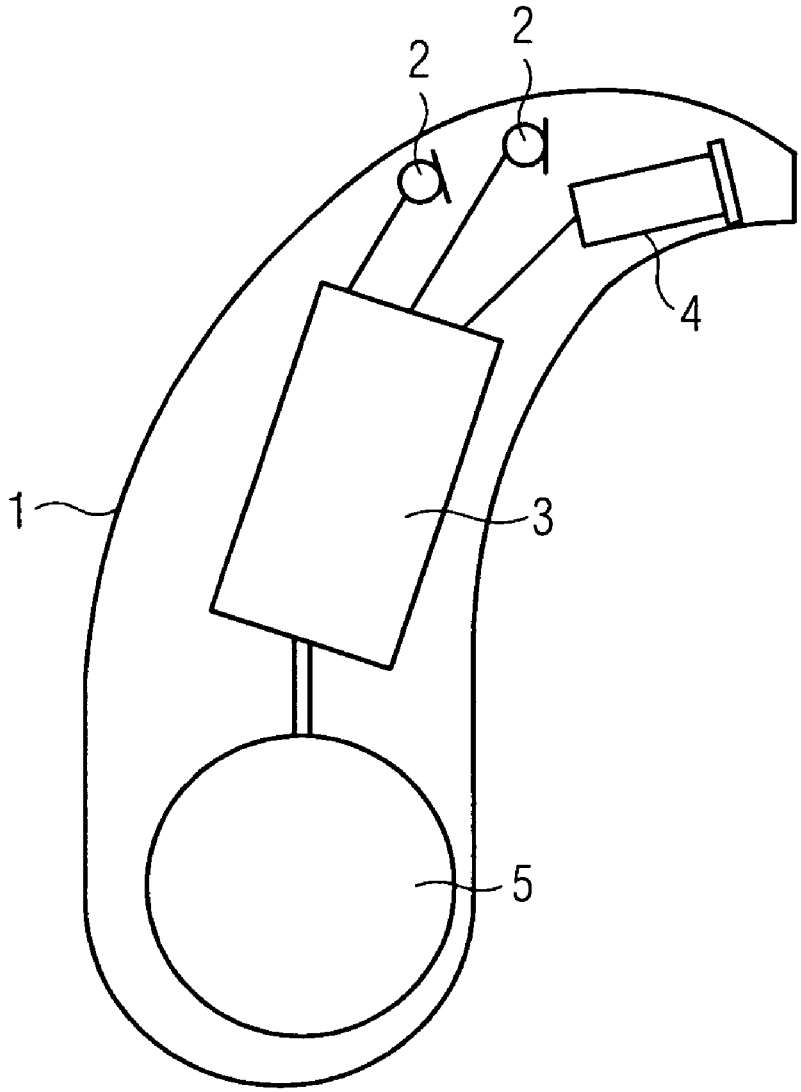
FIG 1 (Prior art)
FIG. 1 shows the basic design of a hearing device according to the prior art.
Figure 2:
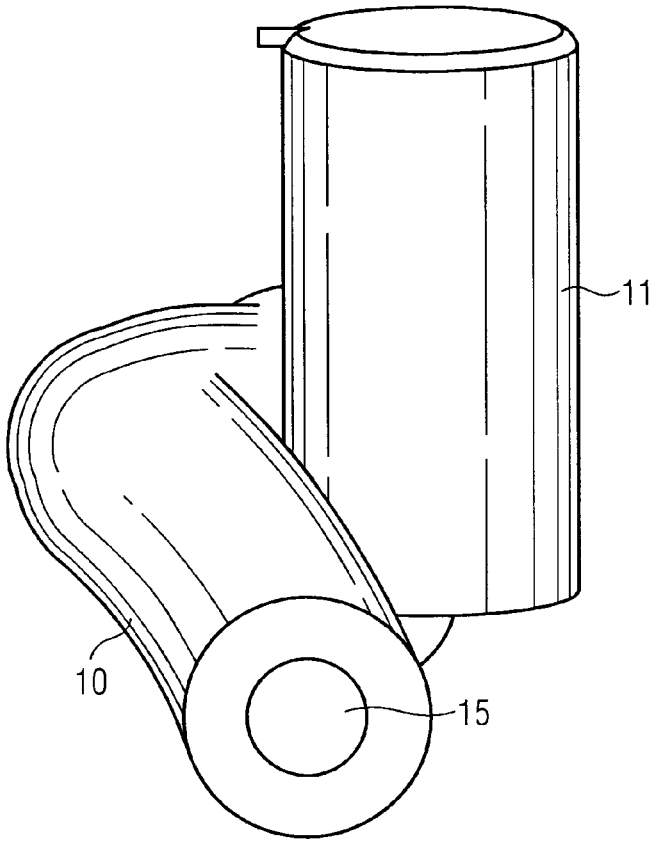
FIG. 2 shows a perspective view of a sound channel, which circulates an obstacle.

FIG. 2 shows a sound channel 10, which is wound around an obstacle 11. A situation of this type occurs particularly in hearing devices if the volume of the hearing device is to be reduced and an obstacle 11 lies here in the alignment of the sound channel 10. This may be the case not only with sound channels, which show the connecting element between the wearing hook and receiver in an BTE hearing device, but instead also in sound channels between a sound entry opening and a microphone for instance.

Figure 3:
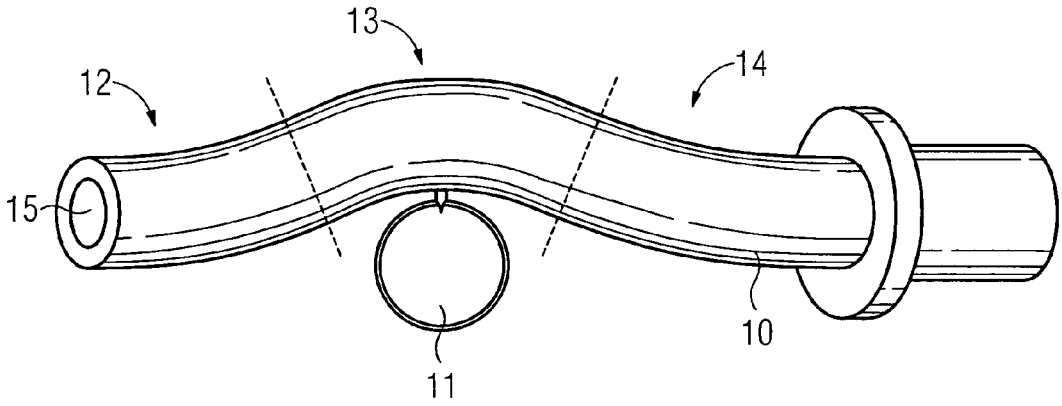
FIG. 3 shows a plan view of the sound channel in FIG. 2.

FIG. 3 shows a plan view of the sound channel 10 and the obstacle 11. The sound channel 10 is subdivided into three sections 12, 13 and 14 purely for orientation purposes. Each of these sections 12, 13 and 14 has a different curvature. In particular, the curvature in the middle section 13 deviates from one of the two outer sections 12 and 14. In the present case, it is not only the extent of the curvature in the middle section 13 which is different to those in the two edge sections 12 and 14, but instead also the sign of the curvature.

Figure 4:
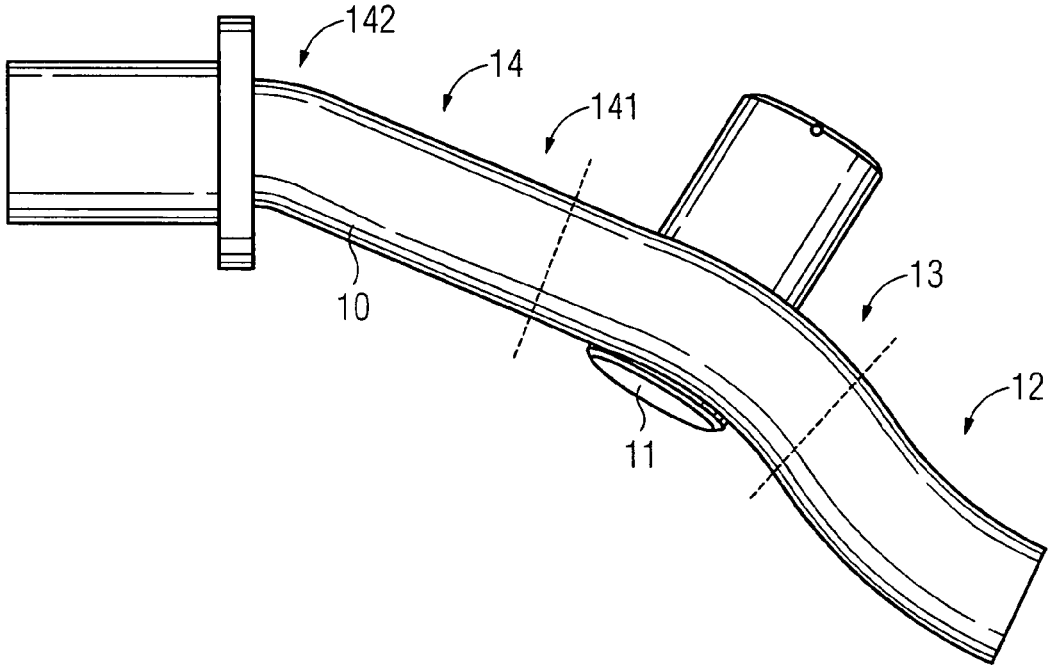
FIG. 4 shows a side view of the sound channel in FIG. 2.

FIG. 4 shows a side view of the sound channel 10 in FIG. 2 and FIG. 3. This view shows that each of the two edge sections 12 and 14 has several different curvatures in each instance. The section 141 from the perspective in FIG. 4 is rather straight for instance while the section 142 is clearly curved. All in all, the sound channel 10 has a plurality of sections with different curvatures in each instance. This can also be attributed in particular back to the sound channel being a three-dimensional structure and thus having different curvatures in three different spatial directions. This means that the curvatures in the individual sections do not only differ in terms of extent and sign, but also in terms of dihedral angle.

The sound channels shown in FIG. 2 to 4 (likewise the sound channel in FIG. 5) are produced as injection-molded parts. With conventional injection molding technology, the interior 15 of the sound channel must be kept free by a corresponding mold during the injection molding process. After the extrusion process, this mold must be removed from the sound channel. If the sound channel only has two different curvatures, the one half of the molded part for the first curvature can be removed from the one side of the sound channel and the other half of the molded part with the second curvature can be removed from the other opening of the sound channel. With more complex designs of the sound channel according to FIG. 2 to 4, it is however not possible to draw the molded part or parts out of the sound channel in accordance with conventional technology.

In accordance with the invention, a negative of the sound channel which keeps the interior 15 free and is made from a low melting material is thus fixed in the injection molding tool as a place holder. The negative is embodied as a plastic injection-molded part for instance. The interior of the injection molded tool is purged with a metal or a ceramic using the place holder. A connecting element, for instance sound channel made of titanium or another metal, is thus produced for instance in a metal-injection-molding process MIM. On the other hand, zirconium dioxide ($ZrO_2$) or another ceramic can produce a sound channel as a ceramic injection-molded part for instance. Following the extrusion process, the negative is burnt or melted out. In the case of the ceramic injection molding process, this burning out can take place together with the burning out of the binding agent. The production process of the ceramic injection molded part is thus concluded such that the finished green compact is sintered.

Figure 5:
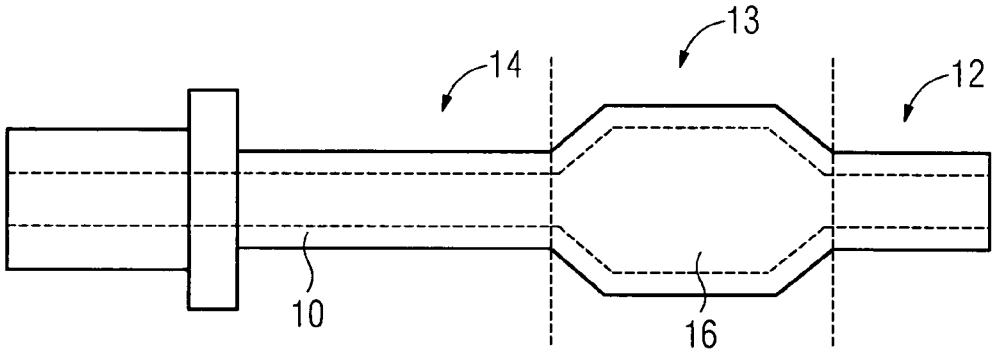
FIG. 5 shows an inventive sound channel with a cavity.

A further exemplary embodiment of an injection-molded sound channel is shown in FIG. 5. Here the sound channel 10 has a cavity 16 with an enlarged internal circumference. While the internal circumference in the two edge sections 12 and 14 is relatively small, it is significantly larger in the middle section 13 than in the two edge sections 12 and 14. A sound channel of this type for a hearing apparatus which has an approximate internal diameter of one millimeter in the edge regions 12 and 14, may not be produced with conventional injection molding technology, since a place holder for the cavity 16 may not be removed from the sound channel 10 according to one of the two sides. The inventive production method also firstly enables in this instance an injection molding of the sound channel, in which the negative is namely melted or burnt out of the sound channel after the extrusion process. Here the cavity can naturally adopt any form, like for instance square, cylindrical, circular and such like.

The inventive production method thus allows a very high level of creative freedom of the sound channel. Undercuts can also be introduced, like is the case for instance with cavities, branchings or other complex guides of the sound channel. The sound channel can thus be provided with additional acoustic functions, like can be realized for instance by nozzles and cavities.

The conversion of the afore-illustrated method is also conceivable for other hearing device components like the wearing frame for fixing hearing device components or housings for silicon microphones.

The invention claimed is:

1. A method for producing a sound channel for a hearing apparatus, comprising:

providing an injection-molded form for the sound channel, the sound channel having, in the longitudinal direction, a first outer section, a second outer section and a middle section, the middle section having a different curvature or a larger internal circumference than the outer sections;

fixing a negative of the sound channel within the injection-molded form, the negative comprising of a first material, effusing the injection-molded form with a second material in order to cast the sound channel, the second material having a higher melting point than the first material; and removing the negative from the cast sound channel.

2. The method as claimed in claim 1, wherein removing is by melting the negative from the cast sound channel.

3. The method as claimed in claim 1, wherein removing is by burning the negative from the cast sound channel.

4. The method as claimed in claim 1, wherein the second material is a metal.

5. The method as claimed in claim 2, wherein the metal is titanium.

6. The method as claimed in claim 1, wherein the second material is a ceramic.

7. The method as claimed in claim 6, wherein the ceramic contains $ZrO_2$.

8. The method as claimed in claim 6, wherein the sound channel being sintered after removing the negative.

9. The method as claimed in claim 1, wherein the negative is a plastic injection-molded part.

10. The method as claimed in claim 1, wherein a nozzle is molded in or on the sound channel.

11. The method as claimed in claim 1, wherein a cavity is molded in or on the sound channel.

12. The method as claimed in claim 1, wherein the sound channel has at least one branch.

13. A sound channel for a hearing apparatus, comprising:

in the longitudinal direction: a first outer section, a second outer section and a middle section, wherein each section has a hollow interior formed from a removal of a negative, the negative comprises a first material, wherein each section comprises a surface formed from an injection-molding of a second material, the second material having a higher melting point than the first material, and wherein the middle section has a different curvature or a different internal circumference than the outer sections.

14. The sound channel as claimed in claim 13, wherein the second material is a metal.

15. The sound channel as claimed in claim 13, wherein the second metal is a ceramic.

16. The sound channel as claimed in claim 15, wherein the sound channel is sintered after removal of the negative.

17. The sound channel as claimed in claim 13, further comprises a cavity.

18. The sound channel as claimed in claim 13, further comprises a nozzle.

19. The sound channel as claimed in claim 13, further comprises a branch.

* * * * *